US012383065B2

(12) United States Patent
Li

(10) Patent No.: US 12,383,065 B2
(45) Date of Patent: Aug. 12, 2025

(54) HIGH-STABILITY SUPPORT FRAME

(71) Applicant: NINGBO EDEN OUTDOOR PRODUCTS CO., LTD., Ningbo (CN)

(72) Inventor: Taojun Li, Ningbo (CN)

(73) Assignee: NINGBO EDEN OUTDOOR PRODUCTS CO., LTD., Ningbo (CN)

( * ) Notice: Subject to any disclaimer, the term of this patent is extended or adjusted under 35 U.S.C. 154(b) by 14 days.

(21) Appl. No.: 18/510,660

(22) Filed: Nov. 16, 2023

(65) Prior Publication Data

US 2024/0398122 A1 Dec. 5, 2024

(30) Foreign Application Priority Data

May 30, 2023 (CN) ..... 202321348287.8

(51) Int. Cl.
*A47C 7/00* (2006.01)

(52) U.S. Cl.
CPC ..... *A47C 7/00* (2013.01)

(58) Field of Classification Search
CPC .. A47C 7/00; A47C 19/12; A47C 4/00; A47B 3/00
USPC ..... 285/182; 248/188.1, 188.91
See application file for complete search history.

(56) References Cited

U.S. PATENT DOCUMENTS 1,614,539 A * 1/1927 Ryan ..... A47B 3/08 5/310
2,270,656 A * 1/1942 Kiesecker ..... A47C 7/002 248/188.91
2,654,421 A * 10/1953 Neff ..... B60B 33/00 280/35
2,956,705 A * 10/1960 Clingman ..... A47B 47/0008 217/65
3,322,077 A * 5/1967 Kovacik ..... A47B 3/00 108/115
4,904,022 A * 2/1990 Morozzi ..... A47C 4/024 248/188.91
6,182,578 B1 * 2/2001 Fanuzzi ..... A61G 13/105 108/132
6,199,489 B1 * 3/2001 Tsai ..... A47B 3/12 108/115
6,439,656 B1 * 8/2002 Liu ..... A47C 3/029 297/272.1
7,604,289 B2 * 10/2009 Chen ..... A47B 3/14 108/127

(Continued)

*Primary Examiner* — Muhammad Ijaz
(74) *Attorney, Agent, or Firm* — Bayramoglu Law Offices LLC

(57) ABSTRACT

A high-stability support frame is provided. The high-stability support frame includes two primary connecting rods and two secondary connecting rods, where the two primary connecting rods include a first primary connecting rod and a second primary connecting rod; the first primary connecting rod and the second primary connecting rod are intersected; the two secondary connecting rods include a first secondary connecting rod and a second secondary connecting rod; the first secondary connecting rod and the second secondary connecting rod are arranged in parallel; the first secondary connecting rod is connected to a first end of the first primary connecting rod and a first end of the second primary connecting rod; and the second secondary connecting rod is connected to a second end of the first primary connecting rod and a second end of the second primary connecting rod.

6 Claims, 4 Drawing Sheets

(56) References Cited

U.S. PATENT DOCUMENTS

| | | | | |
|---|---|---|---|---|
| 8,424,470 | B2 * | 4/2013 | Volin | A47B 3/091 108/118 |
| 2006/0225624 | A1 * | 10/2006 | Grace | A47B 3/002 108/26 |
| 2009/0241811 | A1 * | 10/2009 | Markegard | A47B 3/00 108/118 |
| 2019/0104850 | A1 * | 4/2019 | Frankel | A47C 4/02 |
| 2019/0335892 | A1 * | 11/2019 | Garrison | A47B 3/12 |
| 2020/0229600 | A1 * | 7/2020 | Schiraga | A47B 91/16 |
| 2020/0281356 | A1 * | 9/2020 | Yang | A47C 5/10 |
| 2021/0282562 | A1 * | 9/2021 | Du | A61G 1/0562 |
| 2021/0345785 | A1 * | 11/2021 | Silinski | A47C 7/70 |
| 2023/0225519 | A1 * | 7/2023 | Cui | A47C 19/12 5/282.1 |
| 2024/0374050 | A1 * | 11/2024 | Giffin | A47D 9/005 |
| 2024/0398122 | A1 * | 12/2024 | Li | A47C 7/00 |

* cited by examiner

HIGH-STABILITY SUPPORT FRAME

CROSS REFERENCE TO THE RELATED APPLICATIONS

This application is based upon and claims priority to Chinese Patent Application No. 202321348287.8, filed on May 30, 2023, the entire contents of which are incorporated herein by reference.

TECHNICAL FIELD

The present disclosure relates to the technical field of support frames, and in particular to a high-stability support frame.

BACKGROUND

At present, camping has become an essential outdoor activity for the younger generation to enjoy weekends. Camping can help people stay away from the hustle and bustle of the city, get close to nature, and enjoy tranquility and fresh air. Camping is a great leisure activity especially for busy people. In addition, camping can exercise people's outdoor survival ability and teamwork spirit, and enhance their physical and mental health. Therefore, more and more people are starting to consider camping as a way of leisure.

Portable folding chairs and tables are essential for camping. When the folding chair is in use, the user's center of gravity is concentrated on the two rear support legs of the folding chair, causing the two rear support legs of the folding chair to further open or slide towards the rear. However, in the prior art, the angle at which the rear support legs of the folding chair open is often small, forming an insufficient support surface. This results in making the folding chair prone to tipping over, thus leading to an unstable factor in use.

SUMMARY

In view of the problems existing in the prior art, the present disclosure provides a high-stability support frame. The high-stability support frame can be used for a folding chair, a folding table, a folding bed, or a footrest, convenient for storage and carrying, and achieving structural stability when the folding chair, the folding table, the folding bed, or the footrest is unfolded.

In order to solve the above technical problem, the present disclosure adopts the following technical solution. A high-stability support frame includes two primary connecting rods and two secondary connecting rods, wherein the two primary connecting rods include a first primary connecting rod and a second primary connecting rod; the first primary connecting rod and the second primary connecting rod are intersected; the two secondary connecting rods include a first secondary connecting rod and a second secondary connecting rod; the first secondary connecting rod and the second secondary connecting rod are arranged in parallel; the first secondary connecting rod is connected to a first end of the first primary connecting rod and a first end of the second primary connecting rod; the second secondary connecting rod is connected to a second end of the first primary connecting rod and a second end of the second primary connecting rod; and there are a total of four support legs for supporting the support frame, with each support leg provided at a connection between the primary connecting rod and the secondary connecting rod.

In a preferred implementation, each two support legs are splayed to expand a support surface of the support frame, preventing the support frame from tipping over and stabilizing the support frame.

In a preferred implementation, the first primary connecting rod and the second primary connecting rod have equal lengths, and the first secondary connecting rod and the second secondary connecting rod have equal lengths. Thus, a triangle formed by the first secondary connecting rod and the two primary connecting rods is the same in shape and area as a triangle formed by the second secondary connecting rod and the two primary connecting rods. The four support legs are evenly stressed, further enhancing the stability of the support frame.

In a preferred implementation, a rivet is provided at an intersection of the first primary connecting rod and the second primary connecting rod, and the first primary connecting rod and the second primary connecting rod are connected by the rivet. The rivet connection is reliable and cost-effective.

In a preferred implementation, there are a total of four connectors, with each connector provided at a connection between the primary connecting rod and the secondary connecting rod; the connector is provided with sockets; and the primary connecting rod, the secondary connecting rod, and the support leg are provided in the sockets.

In a preferred implementation, the primary connecting rod and the connector are connected by a rivet, and the secondary connecting rod and the connector are connected by a rivet. By the rivet connections, the primary connecting rod and the secondary connecting rod are fixed in the sockets to avoid the stability of the support frame from being affected by the rotation of the primary connecting rod or the secondary connecting rod in the socket when the support frame is under force.

In a preferred implementation, the support frame further includes support rods; the support rods are respectively provided on the connectors; and the support rods are matched with the connectors in quantity.

In a preferred implementation, the support rods include two first support rods and two second support rods; and the first support rod and the second support rod have equal lengths.

In a preferred implementation, the support rods include two first support rods and two second support rods, and a length of the first support rod is greater than a length of the second support rod; the support legs include two front support legs and two rear support legs; and the rear support leg is connected to the first support rod, and the front support leg is connected to the second support rod.

In a preferred implementation, the secondary connecting rods are elliptical tubes, polygonal tubes, or irregular tubes.

In a preferred implementation, the support legs are provided with a height adjustment mechanism to adapt to different height requirements.

Compared with existing products, in the present disclosure, the high-stability support frame includes the first primary connecting rod and the second primary connecting rod that are intersected to strengthen the force at the intersection, enhancing the load-bearing capacity of the support frame, and stabilizing the support frame.

BRIEF DESCRIPTION OF THE DRAWINGS

The present disclosure will be further described in detail below with reference to the drawings and preferred embodiments. However, those skilled in the art should understand that these drawings are drawn only for the purpose of explaining the preferred embodiments, and therefore should not be construed as a limitation to the scope of the present disclosure. In addition, unless otherwise specified, the drawings are only intended to conceptually represent the composition or configuration of the described objects and may include exaggerated displays, and the drawings are not necessarily drawn to scale.

REFERENCE NUMERALS

1. first primary connecting rod; 2. second primary connecting rod; 3. first secondary connecting rod; 4. second secondary connecting rod; 5. support leg; 6. connector; and 7. support rod.

DETAILED DESCRIPTION OF THE EMBODIMENTS

In order for those skilled in the art to better understand the technical solution of the present disclosure, the present disclosure is described in detail clearly and completely below in combination with the drawings and embodiments. It should be understood that the specific embodiments described herein are merely intended to explain the present disclosure, rather than to limit the present disclosure.

It is understandable for those skilled in the art that in the description of the present disclosure, terms such as "longitudinal", "transverse" "upper", "lower", "front", "rear", "left", "right" "vertical", "horizontal", "top", "bottom", "inside", and "outside" indicate the orientation or position relationships based on the drawings. They are merely intended to facilitate and simplify the description of the present disclosure, rather than to indicate or imply that the mentioned system or components must have a specific orientation or must be constructed and operated in a specific orientation. Therefore, these terms should not be construed as a limitation to the present disclosure.

The present disclosure provides a high-stability support frame that can be used for a folding table, a folding chair, a folding bed, or a footrest. The high-stability support frame is made of stainless steel or aluminum alloy, and is provided with support legs that are telescopic and adjustable to meet different height requirements. Telescopic adjustment is a commonly used and mature technology in the art, and will not be repeated here.

Embodiment 1

Figure 1:
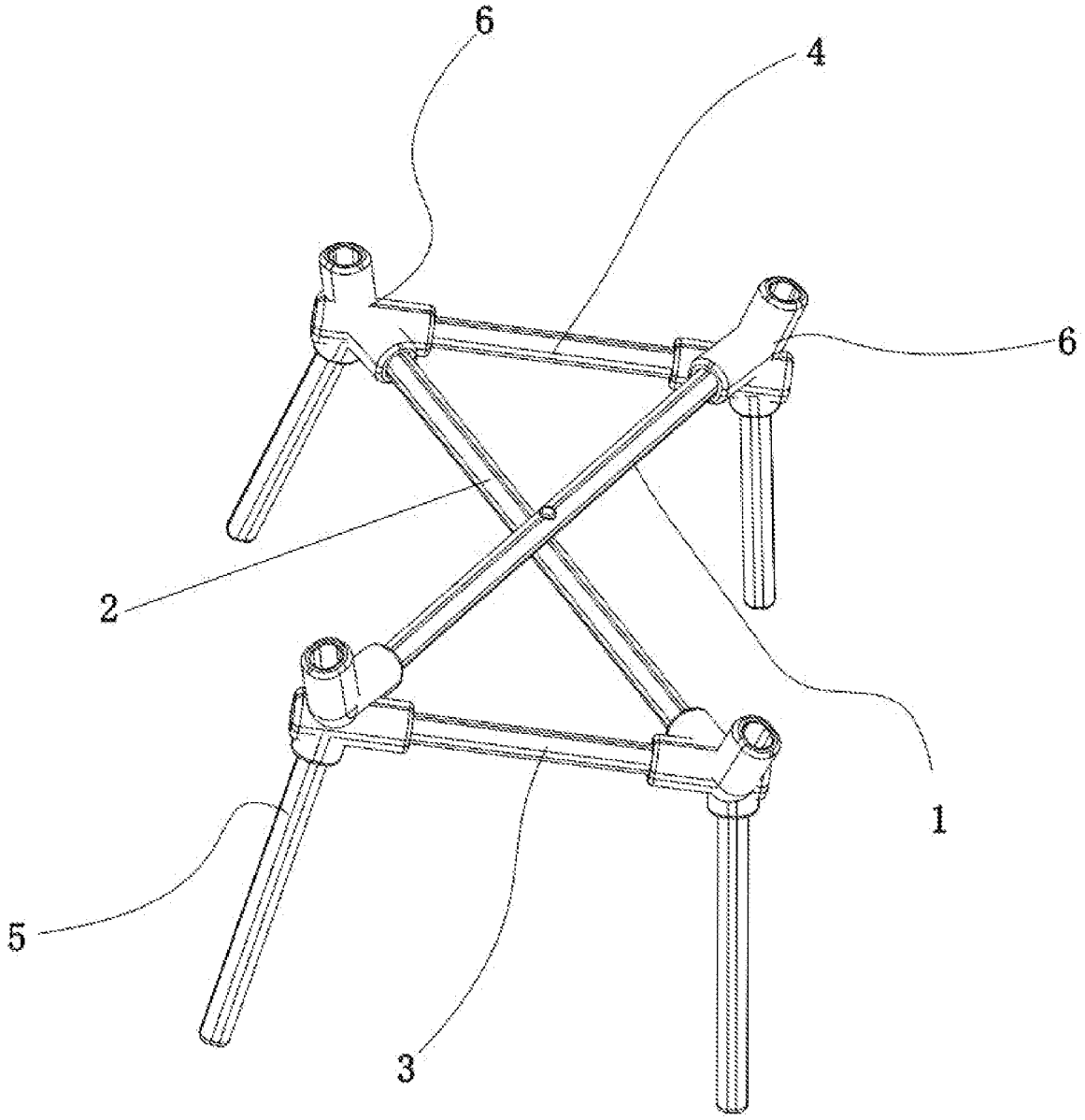
FIG. 1 is a structural diagram of a high-stability support frame according to the present disclosure.
Figure 2:
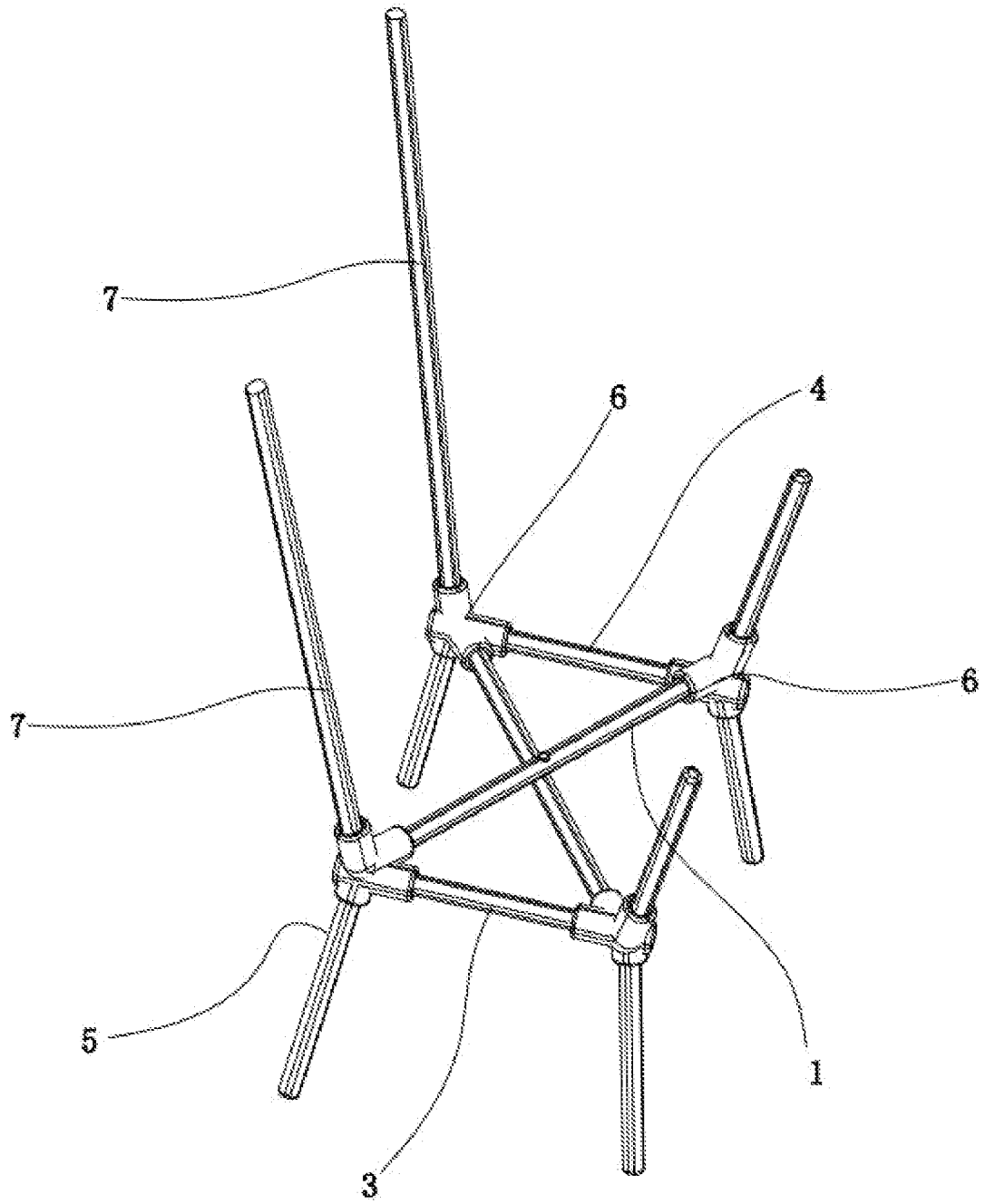
FIG. 2 is a first structural diagram of a high-stability support frame according to Embodiment 1 of the present disclosure.
Figure 3:
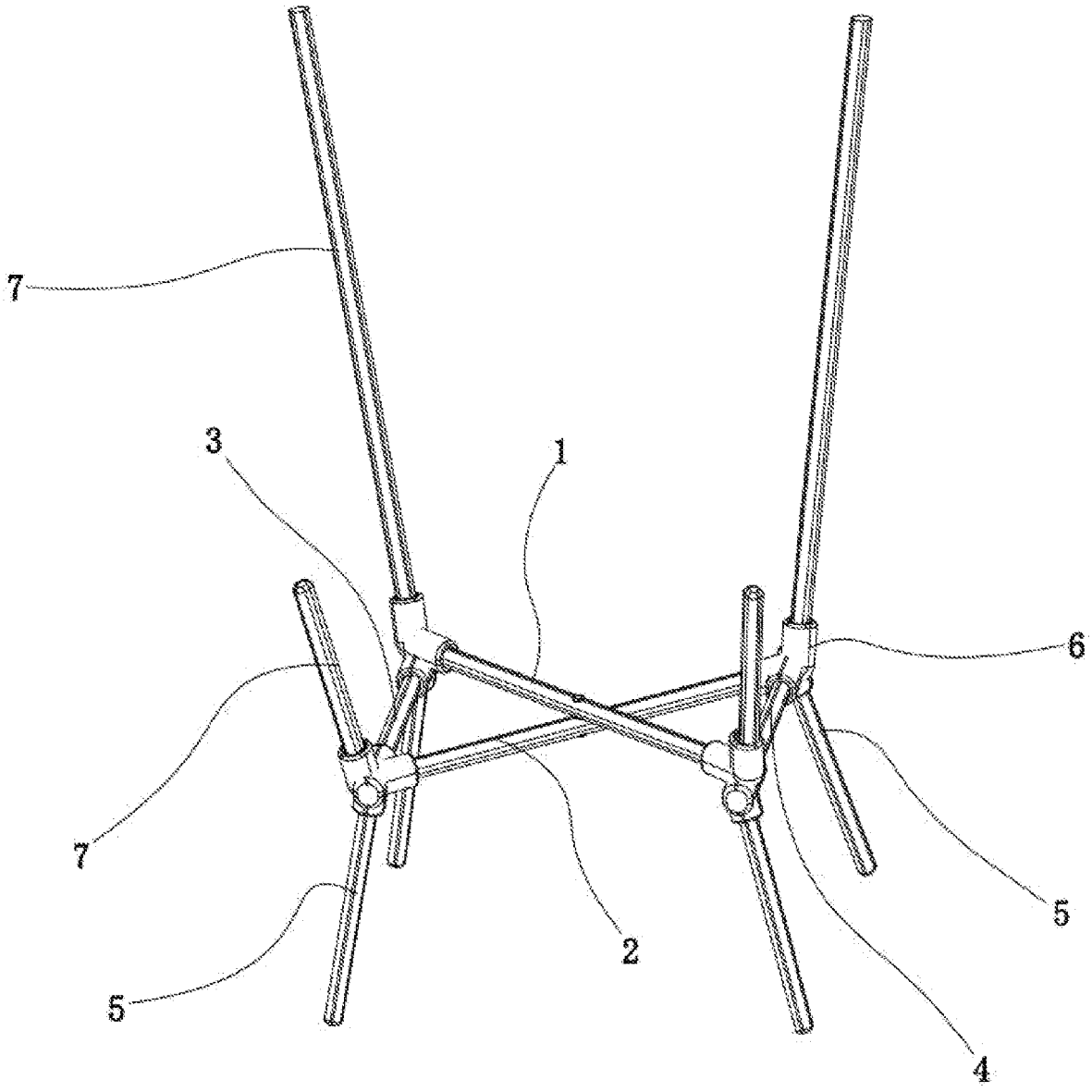
FIG. 3 is a second structural diagram of the high-stability support frame according to Embodiment 1 of the present disclosure.

As shown in FIGS. 1 to 3, a high-stability support frame includes two primary connecting rods and two secondary connecting rods. The two primary connecting rods include first primary connecting rod 1 and second primary connecting rod 2. The first primary connecting rod 1 and the second primary connecting rod 2 are intersected. The two secondary connecting rods include first secondary connecting rod 3 and second secondary connecting rod 4. The first secondary connecting rod 3 and the second secondary connecting rod 4 are arranged in parallel. The first secondary connecting rod 3 is connected to a first end of the first primary connecting rod 1 and a first end of the second primary connecting rod 2. The second secondary connecting rod 4 is connected to a second end of the first primary connecting rod 1 and a second end of the second primary connecting rod 2. There are a total of four support legs 5 for supporting the support frame, with each support leg 5 provided at a connection between the primary connecting rod and the secondary connecting rod. Each two support legs 5 are splayed.

Further, the first primary connecting rod 1 and the second primary connecting rod 2 have equal lengths, and the first secondary connecting rod 3 and the second secondary connecting rod 4 have equal lengths. A triangle formed by the first secondary connecting rod 3 and the two primary connecting rods is the same in shape and area as a triangle formed by the second secondary connecting rod 4 and the two primary connecting rods. The four support legs 5 are evenly stressed, further enhancing the stability of the support frame. A rivet is provided at an intersection of the first primary connecting rod 1 and the second primary connecting rod 2, and the first primary connecting rod 1 and the second primary connecting rod 2 are connected by the rivet. The rivet connection is reliable and cost-effective.

In an embodiment of the present disclosure, there are a total of four connectors 6, with each connector 6 provided at a connection between the primary connecting rod and the secondary connecting rod. The connector 6 is provided with sockets, and the primary connecting rod, the secondary connecting rod, and the support leg 5 are provided in the sockets.

Specifically, the primary connecting rod and the connector 6 are connected by a rivet, and the secondary connecting rod and the connector 6 are connected by a rivet. By the rivet connections, the primary connecting rod and the secondary connecting rod are fixed in the sockets to avoid the stability of the support frame from being affected by the rotation of the primary connecting rod or the secondary connecting rod in the socket when the support frame is under force.

Further, the support frame includes support rods 7. The support rods 7 are respectively provided on the connectors 6. The support rods 7 are matched with the connectors 6 in quantity.

Specifically, the secondary connecting rods are elliptical tubes, polygonal tubes, or irregular tubes.

Figure 4:
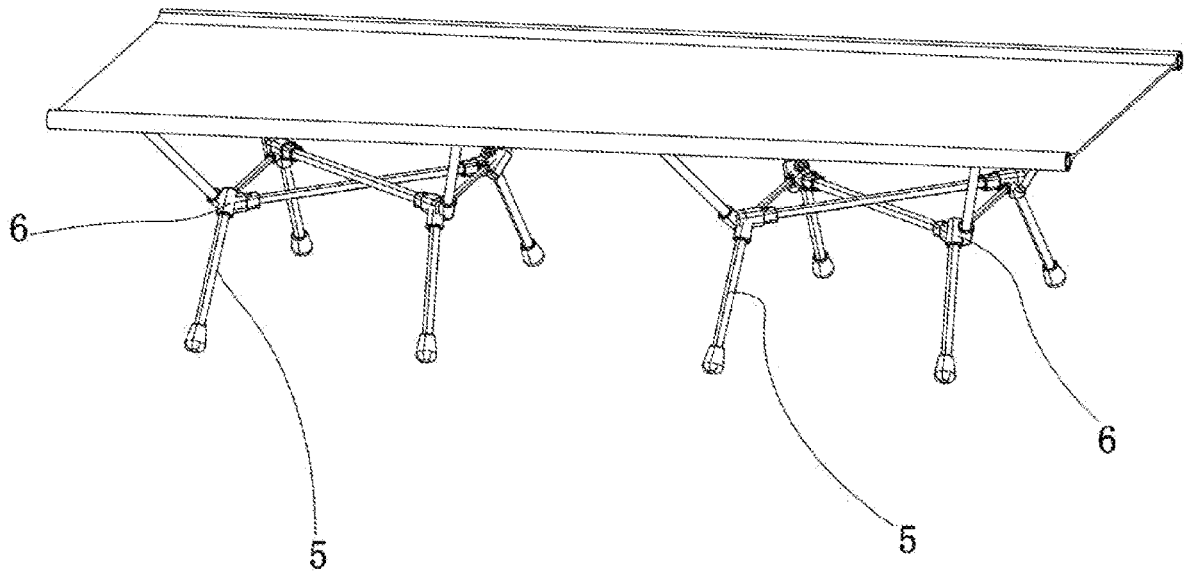
FIG. 4 is a structural diagram of the folding bed according to Embodiment 1 of the present disclosure.
Figure 5:
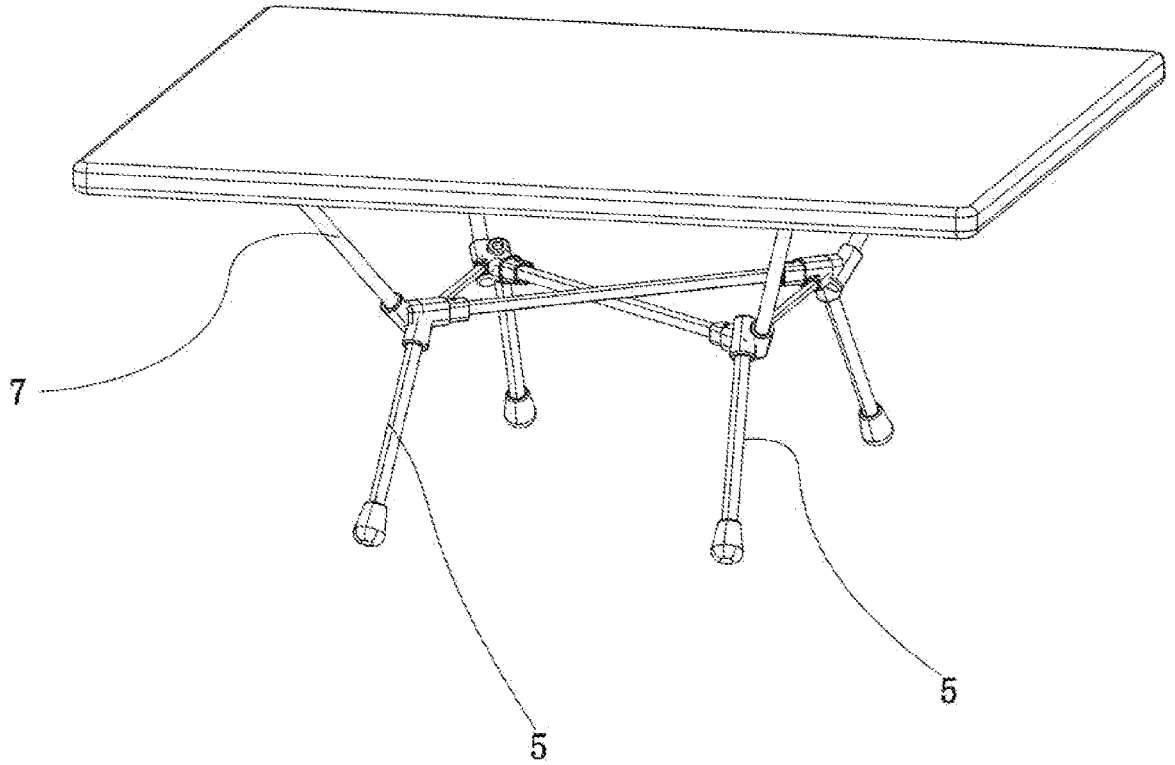
FIG. 5 is a structural diagram of the folding table according to Embodiment 1 of the present disclosure.

In an embodiment of the present disclosure, the support rods 7 include two first support rods 7 and two second support rods 7. The first support rod 7 and the second support rod 7 have equal lengths. In this case, as shown in FIG. 5, the support frame can be used for a folding table, or a footrest. As shown in FIG. 4, multiple support frames can further be combined together for the folding bed.

Embodiment 2

In this embodiment, the support rods 7 include two first support rods 7 and two second support rods 7, and a length of the first support rod 7 is greater than a length of the second support rod 7. The support legs 5 include two front support legs 5 and two rear support legs 5. The rear support leg 5 is connected to the first support rod 7, and the front support leg 5 is connected to the second support rod 7. In this case, the support frame can be used for a folding chair or a footrest.

Other technical features of this embodiment are the same as those of Embodiment 1, and will not be detailed here again.

The present disclosure is described in detail above. Specific cases are used herein to illustrate the principle and implementation of the present disclosure, and the description of the above embodiments is only intended to help understand the core idea of the present disclosure. It should be noted that several improvements and modifications may also be made by those of ordinary skill in the art without departing from the principles of the present disclosure, which also fall within the protection scope of the claims of the present disclosure.

What is claimed is:

1. A high-stability support frame, comprising two primary connecting rods and two secondary connecting rods, wherein the two primary connecting rods comprise a first primary connecting rod and a second primary connecting rod;

the first primary connecting rod and the second primary connecting rod are intersected;

the two secondary connecting rods comprise a first secondary connecting rod and a second secondary connecting rod;

the first secondary connecting rod and the second secondary connecting rod are arranged in parallel;

the first secondary connecting rod is connected to a first end of the first primary connecting rod and a first end of the second primary connecting rod;

the second secondary connecting rod is connected to a second end of the first primary connecting rod and a second end of the second primary connecting rod;

there are a total of four support legs for supporting the high-stability support frame, with each of the four support legs provided at a connection between each of the two primary connecting rods and each of the two secondary connecting rods;

there are a total of four connectors, with each of the four connectors provided at a connection between each of the two primary connecting rods and each of the two secondary connecting rods; each of the four connectors is provided with sockets; and each of the two primary connecting rods, each of the two secondary connecting rods, and each of the four support legs are provided in the sockets;

each of the two primary connecting rods and each of the four connectors are connected by a first rivet, and each of the two secondary connecting rods and each of the four connectors are connected by a second rivet;

the high-stability support frame further comprises support rods; the support rods are respectively provided on the four connectors; and the support rods are matched with the four connectors in quantity; and the support rods comprise two first support rods and two second support rods; and the two first support rods and the two second support rods have equal lengths.

2. The high-stability support frame according to claim 1, wherein the first primary connecting rod and the second primary connecting rod have equal lengths, and the first secondary connecting rod and the second secondary connecting rod have equal lengths.

3. The high-stability support frame according to claim 2, wherein a rivet is provided at an intersection of the first primary connecting rod and the second primary connecting rod, and the first primary connecting rod and the second primary connecting rod are connected by the rivet.

4. The high-stability support frame according to claim 1, wherein the two secondary connecting rods are elliptical tubes, polygonal tubes, or irregular tubes.

5. The high-stability support frame according to claim 1, wherein each two of the four support legs are splayed.

6. A high-stability support frame, comprising two primary connecting rods and two secondary connecting rods, wherein the two primary connecting rods comprise a first primary connecting rod and a second primary connecting rod:

the first primary connecting rod and the second primary connecting rod are intersected;

the two secondary connecting rods comprise a first secondary connecting rod and a second secondary connecting rod;

the first secondary connecting rod and the second secondary connecting rod are arranged in parallel;

the first secondary connecting rod is connected to a first end of the first primary connecting rod and a first end of the second primary connecting rod;

the second secondary connecting rod is connected to a second end of the first primary connecting rod and a second end of the second primary connecting rod;

there are a total of four support legs for supporting the high-stability support frame, with each of the four support legs provided at a connection between each of the two primary connecting rods and each of the two secondary connecting rods;

there are a total of four connectors, with each of the four connectors provided at a connection between each of the two primary connecting rods and each of the two secondary connecting rods;

each of the four connectors is provided with sockets; and each of the two primary connecting rods, each of the two secondary connecting rods, and each of the four support legs are provided in the sockets;

each of the two primary connecting rods and each of the four connectors are connected by a first rivet, and each of the two secondary connecting rods and each of the four connectors are connected by a second rivet;

the high-stability support frame further comprises support rods; the support rods are respectively provided on the four connectors; and the support rods are matched with the four connectors in quantity; and the support rods comprise two first support rods and two second support rods, and a length of each of the two first support rods is greater than a length of each of the two second support rods;

the four support legs comprise two front support legs and two rear support legs; and each of the two rear support legs is connected to each of the two first support rods, and each of the two front support legs is connected to each of the two second support rods.

* * * * *